United States Patent [19]

Bruninga

[11] 4,205,787

[45] Jun. 3, 1980

[54] SPRINKLER HEAD WITH AN IMPROVED SLOTTED DRIVE SPOON

[75] Inventor: Kenneth J. Bruninga, Mapleton, Ill.

[73] Assignee: L. R. Nelson Corporation, Peoria, Ill.

[21] Appl. No.: 950,070

[22] Filed: Oct. 10, 1978

[51] Int. Cl.[2] ..... B05B 3/14; B05B 1/26

[52] U.S. Cl. ..... 239/230; 239/511

[58] Field of Search ..... 239/230–233, 239/504, 505, 507, 509–511

[56] References Cited

U.S. PATENT DOCUMENTS

| | | | |
|---|---|---|---|
| 3,022,012 | 2/1962 | Sharp et al. | 239/230 |
| 3,070,314 | 12/1962 | Warren | 239/230 |
| 3,726,479 | 4/1973 | Leissner | 239/233 |
| 3,952,953 | 4/1976 | Eby | 239/230 |
| 3,955,762 | 5/1976 | Cassimatis et al. | 239/230 |
| 3,977,610 | 8/1976 | Royer | 239/230 |

*Primary Examiner*—Andres Kashnikow

*Attorney, Agent, or Firm*—Cushman, Darby & Cushman

[57] ABSTRACT

A step-by-step rotary sprinkler head having an impact arm with a drive spoon thereon. The drive spoon is preferably of the anti-backsplash type and includes a pull-in reactant surface and a drive-out reactant surface spaced radially and laterally outwardly of the pull-in reactant surface. The pull-in reactant surface has a slot formed in the central portion thereof for enabling a portion of the stream issuing from the sprinkler head outlet to continue its movement into the slot and outwardly therefrom without being deflected onto the drive-out surface when the drive spoon is in stream engagement so that the reactant force established on the drive-out surface is reduced in relation to that which would be established by the deflection of the entire stream thereon.

3 Claims, 3 Drawing Figures

Fig. 1.
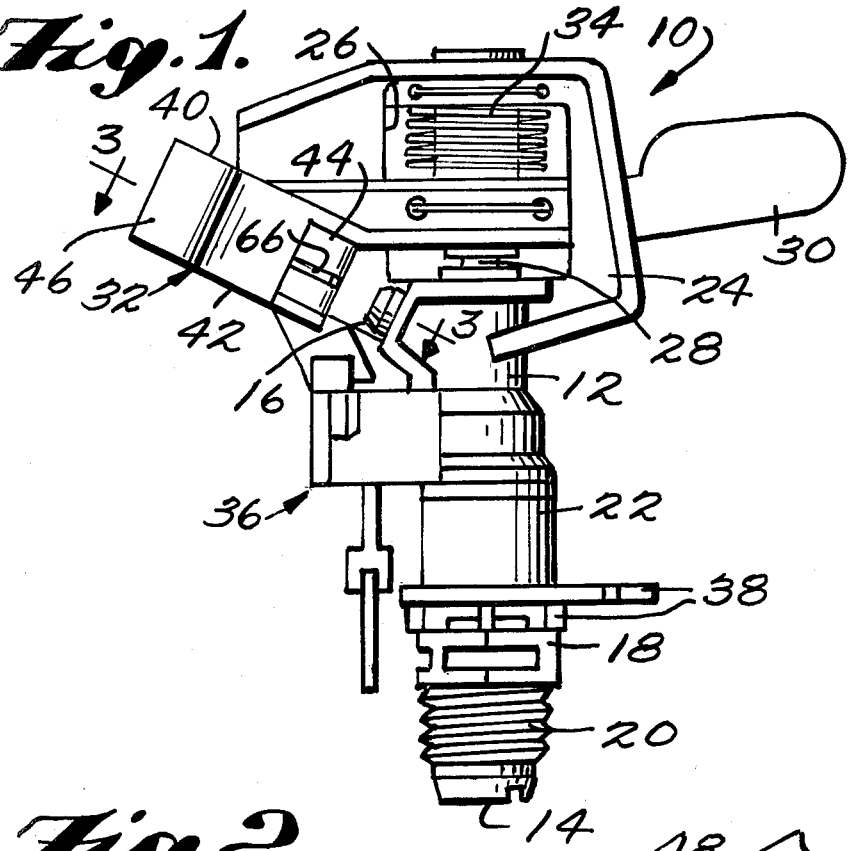
Fig. 2.
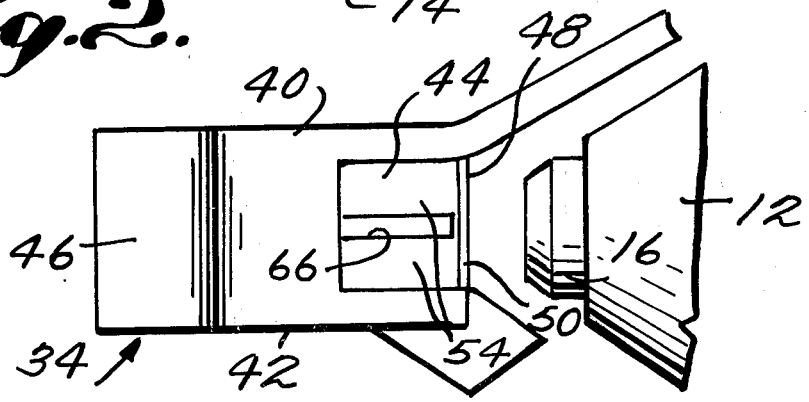
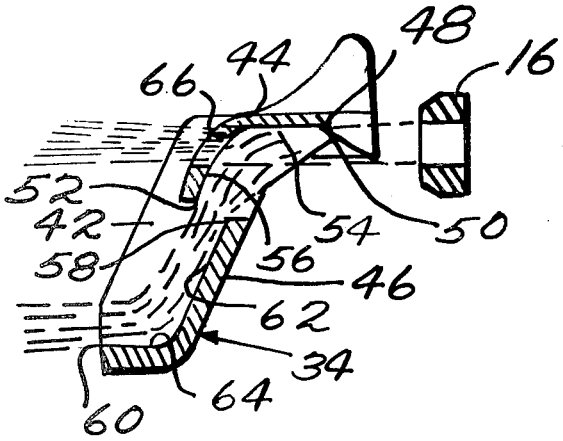
Fig. 3.

SPRINKLER HEAD WITH AN IMPROVED SLOTTED DRIVE SPOON

This invention relates to sprinklers and more particularly to sprinklers of the step-by-step rotary impact type.

Step-by-step rotary impact sprinklers of the type herein contemplated are well known and have received wide commercial acceptance. Sprinklers of this type are produced in a wide range of sizes, the larger sizes finding their greatest utilization in agriculture and turf applications. In recent years the smaller size impact sprinklers have been made of plastic material as, for example, high quality CELCON®, DELRIN and LEXAN®. Impact sprinklers of this type manufactured by the assignee of the present application, L. R. Nelson Corporation, are marketed under the trade name BETA II.

It is usual practice to provide sprinklers in a variety of different models having different capacities by simply providing different nozzle size inserts. In small size sprinklers utilizing plastic components it is sometimes quite difficult to secure proper operation in an appropriate nozzle size range as, for example, from 3/32" to 5/32". The difficulty lies in the fact that the impact arms when made of plastic are light in weight so that when the larger size nozzles are used the reaction forces to the stream established on the drive spoon tend to move the impact arm through a stroke which has an angular extent too great, causing the impact arm to engage the sprinkler body in an unwanted engagement. If the return spring for the impact arm is then increased to prevent this excessive arcuate stroke, an excessive rate of movement or strokes per unit time results. Consequently, it then becomes necessary to add weight to the arm, which is costly.

It has been proposed to modify the configuration of the reactant surface of the drive spoon to alleviate this problem, see for example, U.S. Pat. No. 3,726,479. While an arrangement of this type may be suitable for full circle sprinklers, the arrangement cannot be conveniently embodied within a part-circle sprinkler having a drive spoon arranged to provide for the precision discharge of the water from the drive spoon without splash into those areas where water is not desired. An example of a part-circle impact sprinkler having a drive spoon constructed in this manner is disclosed in my co-pending application, Ser. No. 880,275, filed Feb. 22, 1978, which issued Aug. 14, 1979 as U.S. Pat. No. 4,164,324.

It can thus be seen that any effort to modify the drive out reactant surface of the drive spoon in accordance with the teachings of the aforesaid U.S. Pat. No. 3,726,479 would result in deflecting water within the full circle area where water is not desired by the selected part-circle pattern.

It is an object of the present invention to provide for a simple improvement in the drive spoon construction which will accommodate changes in capacity throughout a desired nozzle size range which is operable in both conventional full circle drive spoon configurations as well as anti-backsplash part-circle drive spoon configurations.

In accordance with the principles of the present invention this objective is obtained by forming a slot in the central portion of the initial pull-in reactant surface of the drive spoon which enables a portion of the stream issuing from the outlet to continue its movement into the slot and outwardly therefrom without being deflected onto the drive out reactant surface when the drive spoon is in stream engagement. In this way the quantity of water which is directed onto the drive out reactant surface is reduced in relation to that which would be established by the deflection of the entire stream thereon and consequently a reduced drive out reactant force is created. Since the slot permits a portion of the water to continue to move in the direction in which the stream moves when the spoon is out of stream engagement, it is apparent that the portion of the stream which flows through the slot will be directed within the desired part-circle pattern. Moreover, the provision of a slot in the surface can be readily accomplished in the molding procedure simply by providing an insert in the die cavity.

Accordingly, it is a further object of the present invention to provide an impact sprinkler of the type described having an improved drive spoon construction which is simple in construction, effective in operation and economical to manufacture.

These and other objects of the present invention will become more apparent during the course of the following detailed description and appended claims.

The invention may best be understood with reference to the accompanying drawings, wherein an illustrative embodiment is shown.

In the drawings:

FIG. 1 is a side elevational view of a part-circle step-by-step rotary impact sprinkler head embodying the principles of the present invention;

FIG. 2 is an enlarged fragmentary side elevational view of the outlet nozzle and drive spoon of the sprinkler head shown in FIG. 1; and FIG. 3 is a fragmentary sectional view taken along the line 3—3 of FIG. 1.

Referring now more particularly to the drawings, for purposes of exemplifying the principles of the present invention the improvements thereof are embodied within a part-circle step-by-step rotary impact sprinkler head, generally indicated at 10, of the type disclosed in my co-pending application Ser. No. 880,275, entitled "Sprinkler Head with Improved Integral Impact Arm and Anti-Backsplash Drive Spoon", now U.S. Pat. No. 4,164,324. It will be understood, however, that the improvements of the present invention have equal applicability to other types of impact sprinklers having more conventional drive spoon configurations.

As shown, the sprinkler head 10 includes a main sprinkler body 12 molded of a suitable plastic material. Connected with the lower portion of the sprinkler body 12 is a tubular member 14, the lower end of which constitutes an inlet for a flow passage extending upwardly through the sprinkler body 12 along a vertical axis of the lower tubular portion and then upwardly and outwardly through an outlet nozzle 16. Mounted for rotational movement about the vertical axis of the lower tubular portion 14 is a sleeve assembly 18. The lower portion of the sleeve assembly 18 has exterior threads 20 formed thereon adapted to engage the internal threads in a suitable source pipe (not shown). When the sleeve assembly 18 is connected with the source pipe by engagement of the threads 20 therewith the sprinkler body 12 is supported by the sleeve assembly 18 carried on the source pipe for rotational movement about a vertical axis. The sleeve assembly 18 has a spring pressed brake sub-assembly 22 associated therewith which serves to restrain the aforesaid rotational movement. It will also be understood that when the sprinkler head 10 is mounted on a suitable source pipe as by engagement of the threads 20 therewith and a source of water under pressure within the source pipe is communicated with the inlet 14, such water under pressure will flow upwardly through the sprinkler body 12 and the upwardly and outwardly through the outlet 16. It will be noted that the outlet 16 has a central longitudinal axis which is disposed within a vertical plane passing through the axis of rotation of the sprinkler body which intersects the vertical axis within such plane at an angle of approximately 25°.

The sprinkler body includes an upper portion 24 having an opening 26 formed therein. Mounted in the upper portion of the sprinkler body 12 and extending through the opening 26 is a shaft 28 having its axis aligned with the vertical axis of rotation of the sprinkler body 12. Mounted on the shaft 28 for oscillatory pivotal movement is an impact arm 30. Formed integrally on one end of the arm 30 is a drive spoon, generally indicated by the numeral 32, which is constructed in accordance with the principles of the present invention. The impact arm 30 is normally biased into an impact limiting position as shown in FIGS. 1-3 wherein the portions of the arm adjacent the shaft 28 engage the upper portion 24 of the sprinkler body on opposite sides of the opening 26. As shown, the bias is provided by a coil spring 34 surrounding the upper end of the shaft 28 and having one end connected with the upper portion of the sprinkler body and the other end thereof connected to the impact arm 30.

The drive spoon 32 is operable to be engaged by the stream when in its impact limiting position and to impart a pivotal or rotary movement to the arm 30 by virtue of the reaction of the water on the spoon in a direction to move the spoon away from the stream. As the arm rotates in a direction to move the spoon away from the stream, spring 34 retards its movement until it is completely stopped and resiliently biased thereby to move in the opposite direction. In this way, as the arm rotates under the action of the spring 34 and moves into its impact limiting position, the upper portion 24 of the sprinkler body is impacted causing the sprinkler body 12 to move about its vertical pivotal axis under the restraint of spring brake 22. Thus, in accordance with usual practice, the impact arm and drive spoon will normally serve to effect a step-by-step rotational movement of the sprinkler body in one direction.

The sprinkler head 10 is provided with a reversing mechanism, generally indicated at 36, which is adapted to cooperate with the impact arm 30 and a pair of adjustable stops 38. The details of construction of the reversing mechanism and its exact mode of operation form no part of the present invention. An exemplary embodiment similar to the illustrative mechanism shown is disclosed in detail in U.S. Pat. No. 3,070,314, the disclosure of which is hereby incorporated by reference into the present specification. For present purposes, it is sufficient to note that in one position, the reversing mechanism is operable to permit the impact arm and drive spoon to function normally to effect a normal step-by-step rotational movement of the sprinkler body. When the sprinkler body reaches a first predetermined position as determined by the position of a first one of the adjustable stops 38, the reversing mechanism 36 is moved into a second position which has the effect of causing the outward movement of the impact arm to effect a rapid step-by-step rotary movement of the sprinkler body in the opposite direction until the latter reaches a second predetermined position of rotational movement determined by the position of adjustment of the other stop wherein the reversing mechanism 36 is moved back into its other operating position.

As previously indicated, the present invention is more particularly concerned with an improved integral construction of the drive spoon 32 with the impact arm 30, the remaining components of the sprinkler head 10 may be of any desired construction. The illustrative embodiment described above is a construction marketed under the tradename NELSON® by L. R. Nelson Corporation. The particular illustrative embodiment shown is a sprinkler head molded of plastic material and hence the impact arm 30 and integral drive spoon 32 are likewise molded of a plastic material. An exemplary plastic material is CELCON® or DELRIN®.

Since the improvements of the present invention have particular applicability to the anti-backsplash type of drive spoon disclosed in my aforesaid application, it is pertinent to include in the present specification a detailed description of the drive spoon construction of the application, which construction is illustrated in the drawings.

For purposes of convenience and accuracy the drive spoon construction 32 will be described in relation to the longitudinal axis of the outlet 16 of the sprinkler head with the integral impact arm 30 and drive spoon 32 disposed in its impact limiting position. As shown, the drive spoon includes upper and lower walls 40 and 42 disposed in a position to receive the stream issuing from the outlet 16 therebetween. The drive spoon 32 also includes an initial stream engaging wall 44 extending between the upper and lower walls 40 and 42 and a final stream engaging wall 46 extending between the upper and lower walls 40 and 42. The final stream engaging wall 46 is spaced with respect to the initial stream engaging wall in a position with all portions thereof disposed outwardly of all portions of the initial wall 44 in a transverse direction corresponding to the direction of movement of the drive spoon 32 away from the impact position as shown in FIG. 3. The interrelationship between the initial wall 44 and final wall 46 is such that a longitudinally inward portion of the final wall 46 is disposed in longitudinally lapped relation with a longitudinally outward portion of the initial wall. Moreover, the relationship is such that a longitudinally outward portion of the final wall 46 is disposed longitudinally outwardly of the longitudinally outward portion of the initial wall 44.

The initial stream engaging wall 44 provides a leading edge portion disposed at an angle of approximately 60° with respect to the longitudinal, the leading edge portion including a laterally inward leading edge 48 and a laterally outward leading edge 50. The initial wall 44 also includes an initial terminal edge 52 which is spaced longitudinally and transversely outwardly from the leading edge 50. Extending between the leading edge 50 and terminal edge 52 is a pull-in water contacting surface including an initial stream receiving portion 54 extending generally longitudinally outwardly from the leading edge 50 with a slight transversely outward extent and a transversely outwardly directing stream portion 56 extending from the initial stream receiving portion 54 in a generally concavely arcuate configuration. As shown, the stream receiving surface portion 54 is flat and is disposed at an angle of approximately 12° with respect to the longitudinal axis. The outwardly directing stream surface portion 56 is arcuate about a fixed axis and extends through an arcuate extent of approximately 68° from its tangential juncture with the flat initial stream engaging surface portion 54. A short terminal section of the surface portion 56 extends tangentially from the arcuate at an angle of approximately 80° with respect to the longitudinal axis.

The final wall 46 includes a final leading edge 58 which is disposed longitudinally between the initial leading and terminal edges 50 and 52 and transversely outwardly from the initial leading edge 50 a distance at least as great as the distance the initial terminal edge 52 is spaced transversely outwardly from the initial leading edge 50. As shown, the transverse spacing of the final leading edge 58 is slightly greater than the transverse spacing of the initial terminal edge 52. The final wall 46 also includes a final terminal edge 60 which is spaced longitudinally and transversely outwardly from the final leading edge 58 and a reactant water contacting surface which extends between the final leading and terminal edges 58 and 60. The reactant surface includes a final stream engaging portion 62 extending generally transversely outwardly from the final leading edge 58 with a slightly longitudinally outward extent and a longitudinally outwardly directing stream portion 64 extending from the final stream receiving portion 62 in a generally concavely arcuate configuration. As shown, the final stream receiving surface portion 62 is preferably of flat configuration and disposed at an angle of 65° with respect to the longitudinal axis. As before, the outwardly directing stream portion is preferably arcuate about a single axis and has an arcuate extent of approximately 80°, the juncture of the portion 64 with the portion 62 being tangential along a line which intersects with a plane coinciding with and extending from the final angular flat surface section of the surface portion 56. The terminal section of the final surface portion may be flat and extends tangentially at an angle of approximately 15° with respect to the longitudinal axis.

While the construction set forth above, which is disclosed in my aforesaid copending patent application, will effectively operate in many sizes without modification in accordance with the principles of the present invention, it is desirable in marketing sprinkler heads to offer a line of sprinkler heads in various sizes. The simplest and most effective manner of accomplishing this marketing objective is to provide a series of different sized sprinkler bodies and impact arms and for each particular sprinkler body size provide a series of different nozzle inserts in which the orifice size varies. For example, in the small size sprinkler body four nozzle orifice sizes may be conveniently provided, as for example, 0.092", 0.110", 0.135" and 0.156".

It will be understood that since the reactant forces acting on the drive spoon to effect its continuous oscillatory movements will change in response to changes in the amount of water flowing through the outlet orifice, some means must be provided for accommodating the inherent differences in the amount of water flowing from the outlet orifice. In accordance with the principles of the present invention, this accommodation is made by providing a slot 66 in the initial stream engaging wall 44 of the drive spoon 32. The slot 66 extends longitudinally through the wall 44 in the central portion thereof. In the exemplary embodiments previously described the slot 66 would be provided in the drive spoons 32 of the impact arms utilized with the larger two sizes of outlet orifices. By utilizing the slot construction in accordance with the principles of the present invention it becomes a relatively simple matter to provide a removable insert in the die assembly which is utilized to form the impact arm and integral drive spoon.

The effect of providing the slot where the larger orifice size nozzle inserts are utilized is to permit a portion of the stream issuing from the nozzle orifice to continue to move longitudinally through the slot, rather than to impinge upon the initial stream engaging wall 44 and to be deflected thereby onto the final wall 46. It will be noted that the portion of the stream which continues its movement through the slot will simply continue its longitudinal movement when the drive spoon is in stream engagement so that virtually none of this portion of the stream would be deflected out of the intended wetting pattern. The effect of allowing a portion of the stream to simply pass longitudinally through the slot without impinging upon any of the reactant surfaces of the drive spoon is to reduce the portions of the stream which do impinge upon the reactant surfaces. In the examples given this reduction in the portion of the water which impinges on the reactant surfaces in the case of the two larger sizes effectively provides a reduction which makes the amount of water impinging upon the reactant surfaces substantially the same as that which is totally provided by the two lower sizes orifices and hence the reactant forces involved are the same. In this way, an effective operation is maintained throughout a desired size range by a very simple expedient which does not require the provision of heavier springs and added arm weights.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A step-by-step rotary sprinkler comprising a sprinkler body having an inlet and an outlet, means for mounting said sprinkler body on a supply conduit having a source of water under pressure communicating therewith for controlled rotational movement about a vertical axis so that the water source flows into said inlet and issues from said outlet as a stream extending upwardly and outwardly, an impact arm mounted on said sprinkler body for water driven pivotal movement away from an impact position and biases pivotal movement toward said impact position, said impact arm having a drive spoon thereon including a pull-in reactant surface facing in a direction to be initially engaged by the stream as said arm moves toward said impact position so that the reaction force established by said stream acts in a direction to move said arm toward said impact position and a drive-out reactant surface disposed radially outwardly of said pull-in reactant surface in position to receive the water deflected from said pull-in reactant surface and facing in a direction to establish a reaction force by the engagement of the stream therewith which acts in a direction to move said arm away from said impact position, the improvement which comprises said pull-in reactant surface having a slot formed in the central portion thereof for enabling a portion of the stream issuing from said outlet to continue its movement into said slot and outwardly therefrom without being deflected onto said drive-out surface when said drive spoon is in stream engagement so that the reactant force established on said drive-out surface is reduced in relation to that which would be established by the deflection of the entire stream thereon.

2. A step-by-step rotary sprinkler comprising a sprinkler body having an inlet and an outlet, means for mounting said sprinkler body on a supply conduit having a source of water under pressure communicating therewith for controlled rotational movement about a vertical axis so that the water source flows into said inlet and issues from said outlet as a stream extending upwardly and outwardly, an impact arm mounted on said sprinkler body for water driven pivotal movement away from an impact position and biased pivotal movement toward said impact position, said impact arm having an anti-backsplash drive spoon thereon including a pull-in reactant surface facing in a direction to be initially engaged by the stream as said arm moves toward said impact position so that the reaction force established by said stream acts in a direction to move said arm toward said impact position and a drive-out reactant surface disposed radially and laterally outwardly of said pull-in reactant surface in a position to receive the water deflected from said pull-in reactant surface and facing in a direction to establish a reaction force by the engagement of the stream therewith which acts in a direction to move said arm away from said impact position, the improvement which comprises said pull-in reactant surface having a slot formed in the central portion thereof for enabling a portion of the stream issuing from said outlet to continue its movement into said slot and outwardly therefrom without being deflected onto said drive-out surface when said drive spoon is in stream engagement so that the reactant force established on said drive-out surface is reduced in relation to that which would be established by the deflection of the entire stream thereon.

3. A part-circle step-by-step rotary sprinkler head comprising:

a sprinkler body including an inlet and an outlet having a longitudinal axis, means adapted to be fixedly secured in communicating relation with a source of water under pressure mounting said sprinkler body for rotational movement about a generally vertical axis with the longitudinal axis of said outlet extending upwardly and outwardly at an angle with respect to the axis of rotation and said inlet in communicating relation to the source of water under pressure so that the latter will issue as a stream along the longitudinal axis of said outlet, impact arm means mounted on said sprinkler body for oscillating movement toward and away from an impact limiting position, said impact arm means having a drive spoon thereon engageable with the stream when said impact arm means is near and in said impact limiting position operable in response to the engagement of the stream therewith to move said impact arm means in a direction away from said impact limiting position and to direct the portion of the stream engaged thereby in a direction generally parallel with the longitudinal axis of said outlet, means for biasing said impact arm means in a direction toward said limiting position so as to move the same in said direction through an impact stroke following the movement of said impact arm means in the opposite direction under the operation of said drive spoon to thereby effect a step-by-step rotary movement of said sprinkler body in one direction, and means operable when said sprinkler body reaches a first predetermined position of rotational movement for causing the movement of said impact arm means in a direction away from said impact limiting position to effect a rapid step-by-step rotary movement of said sprinkler body in the opposite direction until the latter reaches a second predetermined position of rotational movement, said drive spoon being integrally formed as a part of said impact arm means and having a construction related to the longitudinal axis of said outlet when said impact arm means is in said impact limiting position which comprises upper and lower walls in a position to receive said stream therebetween, an initial stream engaging wall extending between said upper and lower walls and a final stream engaging wall extending between said upper and lower walls spaced with respect to said initial stream engaging wall in a position (1) with all portions thereof disposed outwardly of all portions of said initial wall in a transverse direction corresponding to the direction of movement of said spoon away from said impact position, (2) with a longitudinally inward portion thereof disposed in longitudinally lapped relation with a longitudinally outward portion of said initial wall and (3) with a longitudinally outward portion thereof disposed longitudinally outwardly of the longitudinally outward portion of said initial wall, said initial stream engaging wall having an initial leading edge disposed within said stream, an initial terminal edge spaced longitudinally and transversely outwardly therefrom and a pull-in water contacting surface extending between said initial leading and terminal edges including an initial stream receiving portion extending generally longitudinally outwardly from said initial leading edge with a slight transversely outward extent and a transversely outwardly directing stream portion extending from said initial stream receiving portion in a generally concavely arcuate configuration, said final wall including a final leading edge disposed longitudinally between said initial leading and terminal edges and transversely outwardly from said initial leading edge a distance at least as great as the distance said initial terminal edge is transversely outwardly spaced therefrom, a final terminal edge spaced longitudinally and transversely outwardly from said final leading edge, and a reactant water contacting surface extending between said final leading and terminal edges including a final stream receiving portion extending generally transversely outwardly from said final leading edge with a slight longitudinally outward extent and a longitudinally outwardly directing stream portion extending from said final stream receiving portion in a generally concavely arcuate configuration, the reactant water contacting surface of said fial wall being disposed substantially entirely transversely outwardly of a plane passing through the leading edges of said initial and final walls, the improvement which comprises said pull-in surface having a slot formed in the central portion thereof for enabling a portion of the stream issuing from said outlet to continue its movement into said slot and outwardly therefrom without being deflected onto said reactant surface when said drive spoon is in stream engagement so that the reactant force established on said reactant surface is reduced in relation to that which would be established by the deflection of the entire stream thereon.

* * * * *